United States Patent [19]

Pizzo

[11] Patent Number: 4,997,062

[45] Date of Patent: Mar. 5, 1991

[54] SWING SCAFFOLD

[76] Inventor: Remo Pizzo, P.O. Box 69, Armdale, Halifax, Nova Scotia, Canada, B3L 4J7

[21] Appl. No.: 526,038

[22] Filed: May 21, 1990

[30] Foreign Application Priority Data

Sep. 28, 1989 [CA] Canada ..... 614248

[51] Int. Cl.[5] ..... E04G 3/10

[52] U.S. Cl. ..... 182/132; 182/142

[58] Field of Search ..... 182/132, 130, 142, 143, 182/144, 150

[56] References Cited

U.S. PATENT DOCUMENTS

| | | | |
|---|---|---|---|
| 428,769 | 5/1890 | Dodge | 182/132 |
| 1,550,364 | 8/1925 | Johnston | 182/142 |
| 1,616,743 | 2/1927 | Ericsson | 182/132 |
| 2,904,126 | 9/1959 | Meng | 182/132 |
| 2,923,374 | 2/1960 | Harwell . | |
| 3,169,604 | 2/1965 | Pranger | 182/132 |
| 3,318,414 | 5/1967 | Meek | 182/132 |
| 3,438,460 | 4/1969 | Solari . | |

FOREIGN PATENT DOCUMENTS

| | | |
|---|---|---|
| 465647 | 6/1950 | Canada . |
| 477765 | 10/1951 | Canada . |
| 760778 | 6/1967 | Canada . |
| 40037 | 6/1980 | Canada . |
| 12301548 | 12/1987 | Canada . |

OTHER PUBLICATIONS

"Griphoist Newsletter"—Winter 1990.

"Standard"Machines—with Guard Rail Supports—Undated.

"Godl Medal"—Safety Scaffolding Machines Bulletin SS-5C-8 Pages Undated.

*Primary Examiner*—Reinaldo P. Machado

*Attorney, Agent, or Firm*—Killworth, Gottman, Hagan & Schaeff

[57] ABSTRACT

This relates to a swing scaffold assembly comprising a plurality of frames disposed in alignment with each other in spaced apart generally parallel planes. Each such frame includes a lower cross beam and a secondary frame structure supported on an intermediate section of each said cross beam. Opposing end portions of each cross beam extend outwardly from the intermediate beam section. A pair of uprights are each connected to and extend upwardly from the opposing ends of each cross beam. An upper cross member spans the distance between and is interconnected to the upper ends of each pair of these uprights. The secondary frame structure for each frame is arranged such that when the frames are in their spaced apart parallel positions they serve to provide a plurality of raised centrally located supports upon which longitudinally extending planks or the like may be laid thereby to provide a raised central bench for supporting building materials at a height convenient for masons and the like. At the same time those portions of each cross beam which extend outwardly from the intermediate section likewise provide spaced supports for longitudinally extending planks or the like thereby to provide lengthwise extending walkways on opposing sides of the raised central bench when the scaffold is in use. Thus, this raised central bench serves for the storage of brick and other building materials. The bricklayers, for example, can work from the walkway on the building side of the scaffold while the laborers or tenders work in the walkway on the opposite side of the central bench thus avoiding interference between these two groups of workers and providing improved productivity gains.

10 Claims, 3 Drawing Sheets

SWING SCAFFOLD

BACKGROUND OF THE INVENTION

This invention relates to improvements in swing scaffolding systems.

The prior art has provided a wide variety of swing scaffold systems. These systems suffer from various problems. For example, on some of the scaffold systems the layout is such that there is interference between the various groups of workmen, such as between laborers and brick layers thus reducing the efficiency of the operation. Furthermore, in some arrangements workers on the side of the scaffolding facing the building structure being worked on may be somewhat impeded as by braces or winches thus again reducing the efficiency of the operation. Certain scaffolding structures are time consuming to assemble thus increasing labour costs. Other designs are not as stable as they might be owing to the manner in which the winches or hoisting cables are secured to the scaffold frame. Furthermore, many traditional winching systems are costly to manufacture, being unnecessarily complex.

SUMMARY OF THE INVENTION

It is the principal object of the present invention to provide a lightweight easy-to-handle and safe-to-use swing scaffold system which eliminates or alleviates the various difficulties noted above and which may be used in various areas of the construction industry, not only for masonry construction, but also for stone setting work, demolition work, refacing and stuccoing work and other similar operations.

This relates to a swing scaffold assembly comprising a plurality of frames disposed in alignment with each other in spaced apart generally parallel planes. Each such frame includes a lower cross beam and a secondary frame structure supported on an intermediate section of each said cross beam. Opposing end portions of each cross beam extend outwardly from the intermediate beam section. A pair of uprights are each connected to and extend upwardly from the opposing ends of each cross beam. An upper cross member spans the distance between and is interconnected to the upper ends of each pair of these uprights. The secondary frame structure for each frame is arranged such that when the frames are in their spaced apart parallel positions they serve to provide a plurality of raised centrally located supports upon which longitudinally extending planks or the like may be laid thereby to provide a raised central bench for supporting building materials at a height convenient for masons and the like. At the same time those portions of each cross beam which extend outwardly from the intermediate section likewise provide spaced supports for longitudinally extending planks or the like thereby to provide lengthwise extending walkways on opposing sides of the raised central bench when the scaffold is in use. Thus, this raised central bench serves for the storage of brick and other building materials. The bricklayers, for example, can work from the walkway on the building side of the scaffold while the laborers or tenders work in the walkway on the opposite side of the central bench thus avoiding interference between these two groups of workers and providing improved productivity gains.

The scaffolding assembly will also typically include suitable bracing members interconnected between the frames to secure them in their spaced parallel relationship. The bracing members are preferably arranged so that one longitudinal side of the assembly is open and devoid of bracing members between adjacent frames thereby to provide greater freedom to and less obstruction to workers on that side of the scaffolding assembly.

Preferably, each frame of the scaffold assembly includes a spaced apart pair of connectors fixed to upper portions of the above-noted secondary frame structure and to which connectors respective vertically disposed lifting ropes are attached when in use. The arrangement is such that lifting forces on each frame are applied at a sufficiently high level relative to each frame as to ensure good stability.

In a typical system an outrigger beam is fixed above each of the scaffold frames. A pair of lifting ropes extend downwardly from each outrigger beam and these are connected each to a respective one of the above noted connectors. Each of the frame upper cross members is provided with suitable apertures through which the lifting ropes extend. This provides a further measure of stability to the structure.

Suitable hoisting means cooperate with the lifting ropes and are accessible to workers standing on the above-noted walkways thereby to effect raising or lowering of the scaffold frames and the planking materials supported thereon.

In a further aspect this invention also relates to the individual frame units for the swing scaffolding system substantially as described above.

Further features and advantages of the invention will become apparent from the following description of a preferred embodiment of same.

BRIEF DESCRIPTION OF THE VIEWS OF DRAWINGS

DETAILED DESCRIPTION OF A PREFERRED EMBODIMENT

Figure 1:
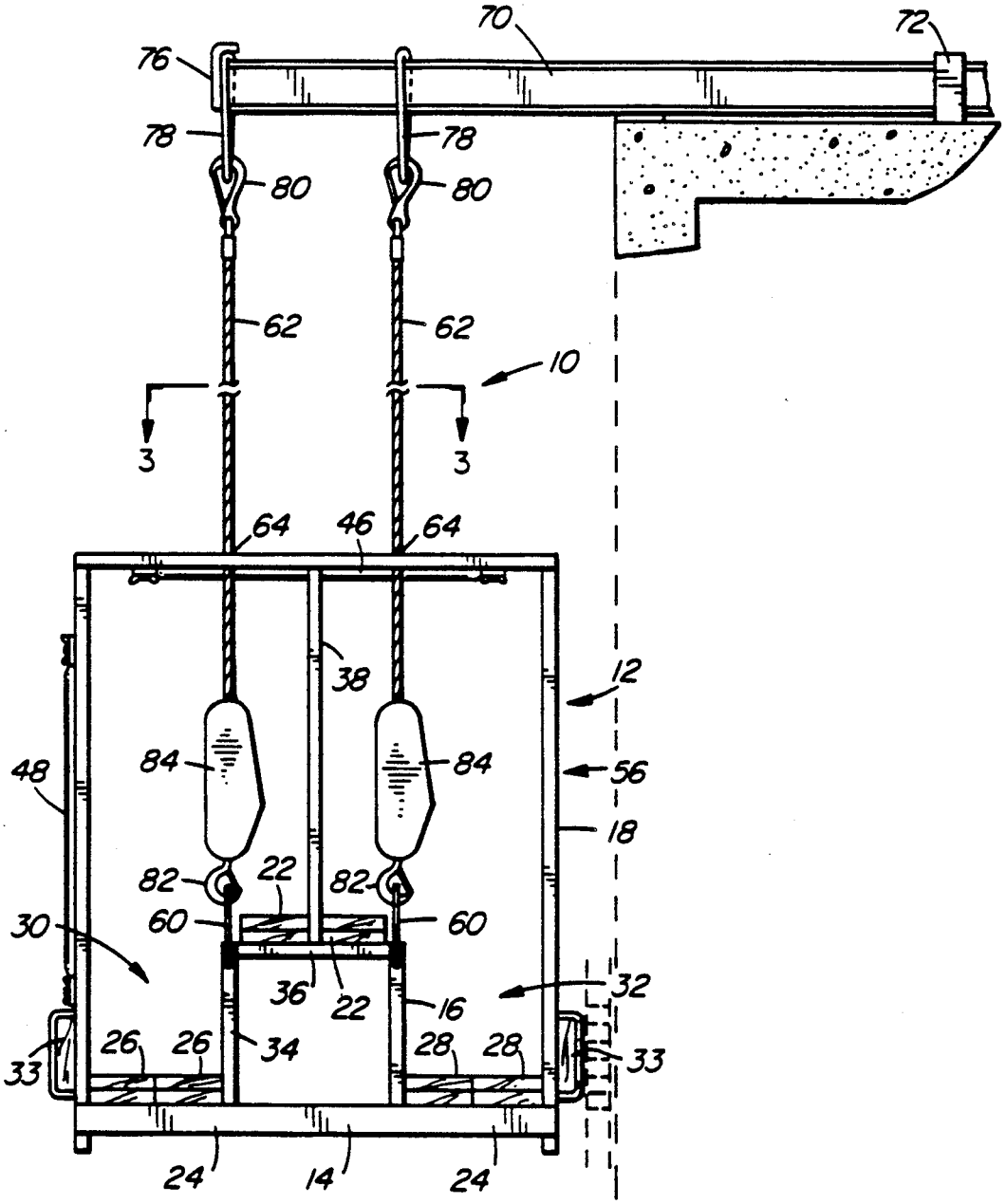
FIG. 1 is an end elevation view of a swing scaffold system incorporating the principles of the present invention.

Referring now to the drawings, there is shown a swing scaffold system 10 including a multiplicity of frames 12 arranged in general alignment with each other in spaced apart generally parallel planes. As best seen in FIG. 1, each frame 12 includes a sturdy lower cross beam 14 with a secondary frame structure 16 supported on an intermediate section of cross beam 14. A pair of vertical uprights 18 are each connected to and extend upwardly from an associated one of the opposing ends of cross beam 14. An upper cross member 20 spans the distance between and is interconnected tO the upper ends of each of the pair of uprights 18.

Figure 2:
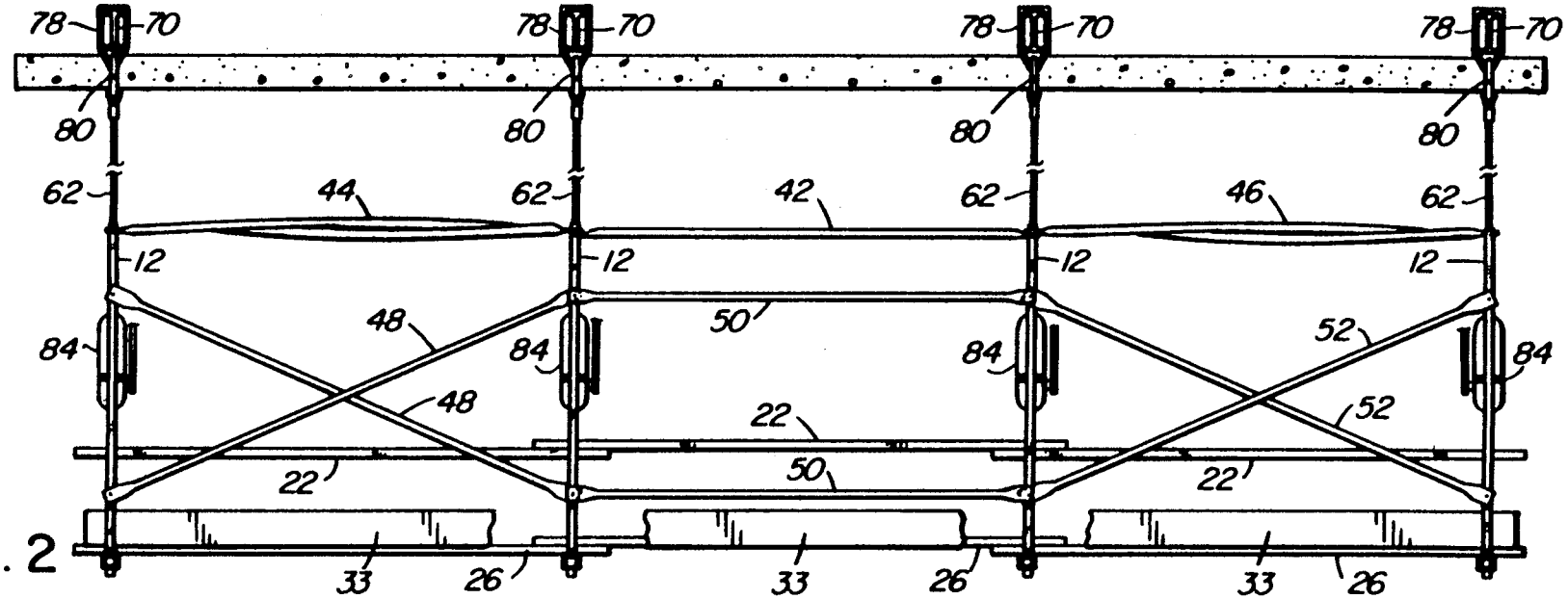
FIG. 2 is a rear elevation view of the swing scaffold system.
Figure 3:
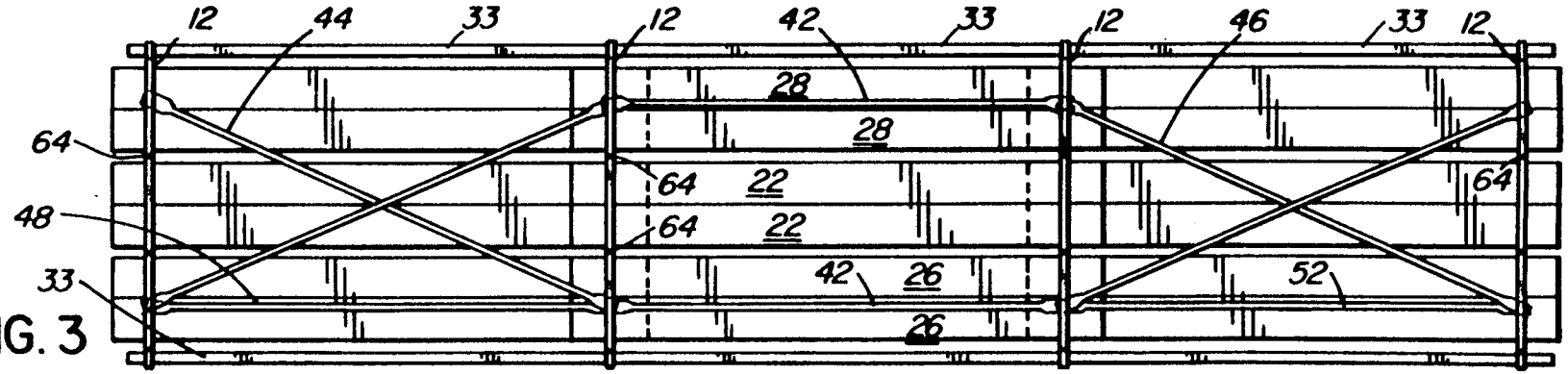
FIG. 3 is a top plan view thereof.
Figure 4:
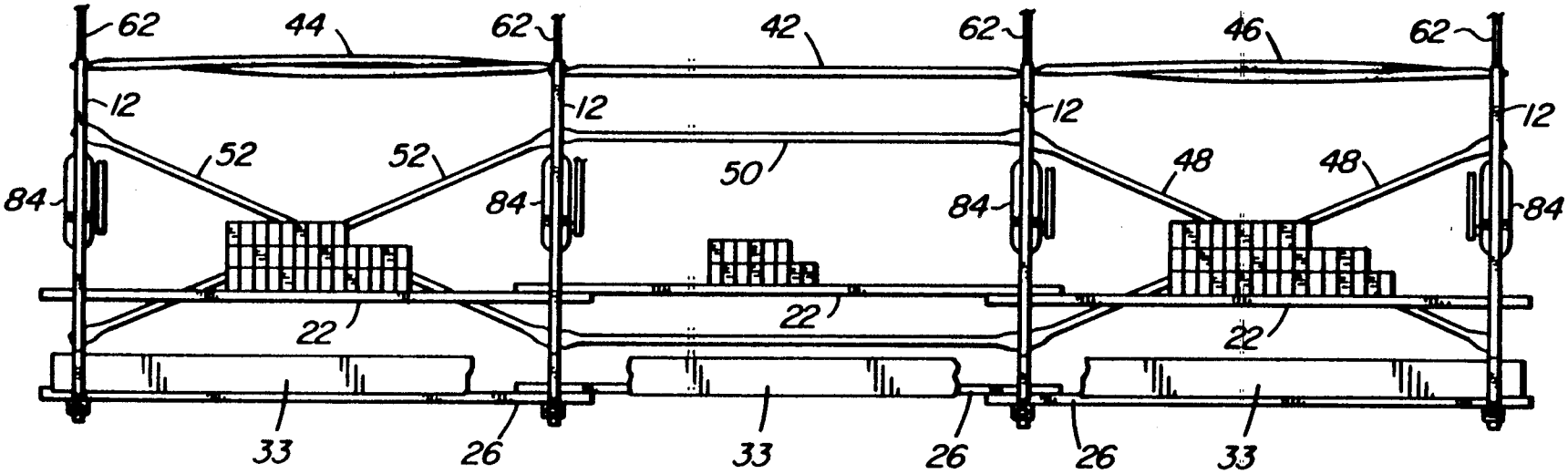
FIG. 4 is a front elevation view thereof.

It will readily be seen from the drawings that the secondary frame structures 16 of the several frames are arranged such that when the frames 12 are in their spaced apart parallel pOsitiOns as shown in FIGS. 2 and 3, there is effectively provided a multiplicity of raised centrally located supports upon which longitudinally extending planking 22 may be laid thereby to provide a raised central bench for supporting building materials, such as brick and mortar, at a height convenient for masons, bricklayers and the like. At the same time those portions 24 of each cross beam which extend outwardly from the intermediate beam section likewise provides spaced supports for longitudinally extending planking 26 and 28 thereby to provide lengthwise extending walkways 30, 32 on opposing sides of the raised central bench provided by the secondary frame structures 16 and planking 22 for purposes noted previously. Toe boards 33 extend along the longitudinal sides of the scaffold assembly just above the walkways 30,32 for purposes well known in this art.

The secondary frame structures 16 each comprise a spaced apart pair of short uprights 34 fixed to cross beam 14 with a horizontal member 36 spanning between and being rigidly fixed to the upper ends of uprights 34. In order to provide increased stability, a vertically extending member 38 extends from the midpoint of the upper cross member 20 downwardly to the midpoint of member 36 and is fixed thereto.

The various frame components referred to above are typically tubes formed with a rectangular cross section thereby to provide good strength and lightness of weight. The components are all securely welded together.

In order to secure the several frames 12 together in the desired spaced parallel relationship, the swing scaffolding assembly is provided with a multiplicity of bracing members. Bracing members 42, 44 and 46 extend between the upper extremities of the several frames 12, such bracing members being tubular members of suitable strength and rigidity and being secured to the various frames by way of suitable pins fixed to the various frames 12, which pins extend through apertures provided in the flattened end portions of the brace tubes. These details are in themselves well known in the scaffolding art and need not be described any further. It will be noted that the brace members 44 and 46 located over the opposing end sections of the scaffolding system are in a cross-over or X pattern while the brace members 42 in the intermediate section are disposed in spaced apart parallel relationship.

In similar fashion, the rear face of the scaffolding system is provided with brace members 48, 50 and 52. The brace members 48 and 52 at the opposing end sections of the scaffold are in the cross-over or X pattern while in the intermediate section the brace members 50 are located in spaced parallel relationship. It is important to note that the building side or working side 56 of the scaffold (which may also be referred to as the front side of the scaffold) is completely open and unobstructed between the uprights 18 on that side of the respective frames 12. In other words, no bracing members are provided. This of course provides greater freedom for and less obstruction to workers such as bricklayers working from the scaffolding assembly.

It is also important to note that each frame 12 includes a spaced apart pair of connectors 60 which are securely fixed or welded to upper portions of the secondary frame structure 16. As best seen in FIG. 1, vertically disposed lifting ropes 62 are connected to these connector elements 60 such that lifting forces on each frame are applied thereto at a sufficiently high level relative to each frame 12 as to provide good stability to the swing scaffold arrangement. These lifting ropes 62 pass upwardly through the frame upper cross member 20 via suitable apertures 64 provided therein. The connectors 60 typically each comprise a sturdy steel bar formed into an inverted U-shape with the ends of same being securely welded to the upper portions of the secondary frame assembly 16.

With continued reference to FIG. 1 as well as to FIG. 2, an outrigger beam 70 is fixed above each of the frames 12 of the scaffold assembly. Each outrigger beam 70 is shown as resting on and secured to a concrete slab by way of an anchor plate 72 fixed to the concrete by means of an anchor bolt 74. The outrigger beam 70 is provided at its outer end with a stop bolt 76 and the outer end portion of the outrigger beam is provided with spaced-apart shackles 78. The upper ends of the wire lifting ropes 62 are provided with suitably manufactured hooks 80 which are clipped onto the shackles 78. Similar hooks 82 are engaged with the U-shaped connectors 60 and these hooks 82, in turn, are each connected to a respective one of the wire rope lifting devices 84.

These wire rope lifting devices 84 are an improvement over the usual winches used in many prior art systems. The difference is mainly in that the wire rope passes through the wire rope lifters rather than being stored on winch drums. The usefulness of a drum type winch system is limited by the length of wire rope that may be stored On the winch drum. Typically this is in the order of 120 feet. In contrast, a wire rope lifting device allows indefinite height for highrise buildings. As noted previously, the two wire ropes 62 are fed through apertures 64 in the frame upper cross member 20 and this provides additional stability against skewing and twisting of the frames under unbalanced loads acting thereon. It will also be noted that the wire rope lifting devices 84, being located inwardly from the opposing sides or faces of the scaffolding system, are well clear of the walkways 30 and 32 and thus do not obstruct the various workers while at the same time the workers have easy access to them. This helps to increase productivity. These lifting devices 84 are typically "Tirmaster T-13" machines or equal, preferably with a lifting capacity of over 3000 pounds and a tested lifting capacity of 6600 pounds. All lifting devices are also preferably equipped with a "Blocstop" self clamping jaw built by "Tractel" or equivalent, to prevent the scaffold from falling. In all cases the scaffolding components must be manufactured according to the construction and industry safety standards and regulations which are applicable in the jurisdiction where the equipment is being used.

While a particular embodiment of the invention has been described and illustrated, it will be understood that this is intended as illustrative of the principle of the invention rather than limiting to the particular construction given and accordingly modifications and equivalents may be made without departing from the inventive concept as defined in the appended claims.

I claim:

1. A swing scaffolding assembly comprising a plurality of frames disposed in alignment with each other longitudinally of the scaffolding assembly and in spaced apart generally parallel planes; each said frame including a lower cross beam and a secondary frame structure supported on an intermediate section of each said cross beam with opposing end portions of each cross beam extending outwardly from the intermediate section; a pair of uprights each connected to and extending upwardly from a respective one of the opposing ends of each cross beam, and an upper cross member spanning the distance between and interconnected to the upper ends of each pair of said uprights, said secondary frame structure of each frame being arranged such that when the frames are in their spaced apart parallel positions, there is provided a plurality of raised centrally located supports upon which longitudinally extending planking or the like may be laid whereby to provide a raised central bench extending longitudinally of the scaffolding assembly for supporting building materials at a height convenient for masons and the like while said opposing end portions of each cross beam which extend outwardly from said intermediate section likewise provide spaced supports for longitudinally extending planking or the like thereby to provide lengthwise extending walkways extending parallel to and on opposing sides of the raised central bench when in use.

2. The swing scaffolding assembly of claim 1 including bracing members interconnected between said frames to secure them in said spaced parallel planes.

3. The swing scaffolding assembly of claim 2 wherein said bracing members are arranged so that one longitudinal side of the assembly is open and devoid of bracing members between adjacent said frames whereby to provide greater freedom for and less obstruction to workers on the scaffolding assembly.

4. The swing scaffolding assembly of claim 1, wherein each said frame includes a spaced apart pair of connectors fixed to upper portions of said secondary frame structure and to which connectors respective vertically disposed lifting ropes are attached when in use such that lifting forces On each frame are applied at a sufficiently high level relative to each frame as to assist in providing stability.

5. The swing scaffolding of claim 4 wherein an outrigger beam is fixed above each said frame, a pair of lifting ropes extending downwardly from each said outrigger beam and being connected each to a respective one of said connectors, each rope extending through an associated aperture in said upper cross member of the frame.

6. The swing scaffolding of claim 5 including lifting means cooperating with said lifting ropes and accessible to workers standing on said walkways to effect raising or lowering of the scaffold frames and the planking and materials supported thereon , said lifting means being spaced inwardly from the longitudinal sides of the scaffolding assembly to reduce the amount of obstruction created to workers on said walkways.

7. A frame unit for a swing scaffolding system wherein, in use, a plurality of said frames are disposed in alignment with each other in parallel planes spaced apart in the longitudinal direction of the scaffolding system, said frame unit cOmprising: a lower main cross beam, a secondary frame structure supported on an intermediate section of said beam with opposing end portions of the beam extending outwardly and away from the intermediate section, a pair of uprights each connected to and extending upwardly from a respective one of the opposing ends of the cross beam and an upper cross member spanning the distance between and interconnected to the upper ends of said uprights, said secondary frame structure providing a support parallel to but raised above said beam for planking which spans a plurality of such frame units when in use to provide the scaffolding system with a raised longitudinally extending central bench for supporting building materials while those portions of the cross beam which extend outwardly from said intermediate section likewise provide spaced supports for longitudinally extending planking which, in use, spans a plurality of said frame units to provide lengthwise extending walkways on opposing sides of the raised central bench.

8. The frame unit of claim 7 wherein said frame includes a spaced apart pair of connectors fixed to upper portions of said secOndary frame structure and to which connectors respective vertically disposed lifting ropes are connected when in use such that lifting forces on said frame are applied at a sufficiently high level relative to said frame as to help ensure stability.

9. The frame unit of claim 7 wherein the frame components are welded together.

10. The frame unit of claim 8 wherein said upper cross member is provided with spaced apertures to receive the lifting ropes when in use thereby to further assist in ensuring stability of the frame unit.

* * * * *